US006468369B1

(12) United States Patent
Zhou

(10) Patent No.: US 6,468,369 B1
(45) Date of Patent: Oct. 22, 2002

(54) GAS GENERATING COMPOSITION FOR AIR BAG

(75) Inventor: Xingxi Zhou, Himeji (JP)

(73) Assignee: Daicel Chemical Industries, Ltd., Osaka (JP)

( * ) Notice: Subject to any disclaimer, the term of this patent is extended or adjusted under 35 U.S.C. 154(b) by 0 days.

(21) Appl. No.: 09/290,515

(22) Filed: Apr. 12, 1999

(30) Foreign Application Priority Data

Apr. 15, 1998 (JP) ..... 10-104638

(51) Int. Cl.[7] ..... C06B 31/28; C06B 31/02
(52) U.S. Cl. ..... 149/46; 149/61
(58) Field of Search ..... 149/45, 46, 47, 149/61, 19.1, 19.4, 19.5, 19.8

(56) References Cited

U.S. PATENT DOCUMENTS

| | | | | |
|---|---|---|---|---|
| 3,058,858 A | | 10/1962 | Batchelder et al. | |
| 3,141,294 A | | 7/1964 | Lawrence et al. | |
| 5,596,168 A | * | 1/1997 | Menke et al. | 149/19.4 |
| 5,866,842 A | * | 2/1999 | Wilson et al. | 149/19.6 |
| 5,872,329 A | * | 2/1999 | Burns et al. | 149/36 |
| 5,898,126 A | * | 4/1999 | Yoshida | 149/46 |
| 5,962,808 A | * | 10/1999 | Lundstrom | 149/19.1 |
| 6,019,861 A | * | 2/2000 | Canterberry et al. | 149/19.1 |

FOREIGN PATENT DOCUMENTS

| | | |
|---|---|---|
| DE | 9416112.7 | 2/1995 |
| EP | 0607446 A1 | 7/1994 |
| EP | 0607446 B1 | 7/1994 |
| EP | 0763512 A2 | 3/1997 |
| JP | 06239693 A | 8/1994 |
| WO | WO 9504710 A1 | 2/1995 |
| WO | WO 9627574 A1 | 9/1996 |
| WO | WO 9804507 A1 | 2/1998 |
| WO | WO 9808782 A1 | 3/1998 |

* cited by examiner

*Primary Examiner*—Peter M. Poon
*Assistant Examiner*—Aileen J. Baker
(74) *Attorney, Agent, or Firm*—Birch, Stewart, Kolasch & Birch, LLP

(57) ABSTRACT

There is provided a gas generating composition for an air bag which improves combustion behavior and enhances handling safety, generates a large amount of generating gas on combustion, reduces amount generated of mist, and can downsize and reduce weight of a gas generator itself. The gas generating composition for an air bag comprises (a) a guanidine derivative compound, (b) a phase stabilized ammonium nitrate and (c) a silicon compound acting as a pressure exponent controller or a detonation suppressing agent.

9 Claims, No Drawings

GAS GENERATING COMPOSITION FOR AIR BAG

TECHNICAL FIELD OF THE INVENTION

The present invention relates to gas generating compositions of which combustion gases act as the operation gas for inflating air bags to be mounted in automobiles, aircraft or the like for the protection of the human body.

DESCRIPTION OF THE PRIOR ART

Recently, development has been carried out of non-azide gas generating compositions in place of sodium azide based compositions which have toxic problems, as gas generating compositions for air bag systems mounted in transportation means (vehicles) such as automobiles and the like. As the non-azide gas generating compositions, U.S. Pat. No. 4,909,549 discloses a composition comprising a tetrazole or triazole compound containing hydrogen, and an oxygen-containing oxidant, U.S. Pat. No. 4,369,079 discloses a composition comprising a metal salt of bitetrazole containing no hydrogen, and an oxygen-containing oxidant, and Japanese Patent Application Laid-Open (JP-A) No. 6-239683 discloses a composition comprising carbohydrazide, and an oxygen-containing oxidant.

However, when these non-azide fuels are used, essential are a large amount of metal compounds such as metal salts, metal oxides and the like as oxidants or catalysts. Even though such compositions are improved as compared with azide compositions in a view of toxic properties, they have still problems that combustion products contain mist formed of solid and liquid of metal compounds, and gas generating efficiency decreases due to formation of residues in an inflator, and therefore a large amount of gas generating compositions must be used. Further, when solid mist and liquid mist having high temperature immediately after combustion are allowed to contact directly with a bag, the bag tends to be damaged. To cut off such mist, additional parts such as a metal net-like filter and the like are consequently required. Accordingly, weight reduction and downsizing of a gas generator itself is difficult to be achieved with a gas generating composition which forms a large amount of mist and consequently exhibits low gas generating efficiency.

Use of a non-metal compound as an oxidant such as ammonium perchlorate or ammonium nitrate is advantageous for reduction of mist and improvement of gas generating efficiency because these compounds turn into gases on combustion. However, when a composition containing a large amount of ammonium perchlorate burns, a hydrochloric acid gas is generated in amount in significantly excess of allowable value for human bodies and environments. Ammonium nitrate, whose one of phase transition temperatures is in normal temperature range (about 32° C.), changes largely in volume when passing the transition temperature. Large change in volume of a molded article leads to unstability in abilities of the composition, therefore, a composition containing ammonium nitrate showing large change in volume is not suitable to be used in environment wherein an automobile air bag is exposed to various temperature changes.

For solving such problems when ammonium nitrate is used, there is a method such that a phase stabilized agent which can suppress shift of phase transition temperature and change in volume is added to ammonium nitrate. For example, WO095/04710 discloses a gas generating composition comprising a phase stabilized ammonium nitrate, a nitrogen-containing compound such as triaminoguanidine nitrate to be used as a fuel, and an organic binder. Moreover, U.S. Pat. No. 5,545,272 and WO096/27574 disclose a gas generating composition which obtains a melting point of 100° C. or more by using, as essential components, 35 to 55% by weight of nitroguanidine and 45 to 65% by weight of a phase stabilized ammonium nitrate.

However, such a composition has high initiation sensitivity and causes a problem that there exists constantly crisis accompanying production, transportation and other handling in large amount. Further, there are other problems of such a composition that the composition is burnt successfully in relatively high pressure range, while at lower pressure range, a pressure exponent which indicates the sensitivity of burning rate against combustion pressure is high, and in some cases, combustion is interrupted or ignition is impossible.

It is desirable for a gas generating composition for an air bag that it is safe against human bodies and environments, the gas output is high, the amount produced of solid and liquid particles (residues), namely the amount produced of metal compounds is small, and safety regarding handling such as production, transportation and the like is high, and further, it is stable against change in pressure and the like. Therefore, the known gas generating compositions as described above can not be satisfactory regarding application to air bag systems.

DISCLOSURE OF THE INVENTION

An object of the present invention is to provide a gas generating composition for an air bag which can enhance safety of producers and users when applied to air bag system by improving combustion behavior and handling safety, and can downsize and reduce weight of air bag system.

The present inventors have found that the above described object can be attained by the following way and completed the present invention; By combining a phase stabilized ammonium nitrate with a compound having pressure exponent adjustment effect or detonation inhibition effect as well as utilizing synergistic action with other components, the problems caused when a phase stabilized ammonium nitrate is used as an oxidant can be solved and only advantages thereof can be provided.

Namely, the present invention provide a gas generating composition for an air bag comprising (a) a guanidine derivative compound, (b) a phase stabilized ammonium nitrate and (c) a silicon compound having an activity as a pressure exponent adjuster or a detonation inhibitor.

The invention provides a gas generating apparatus which comprises the composition as defined above, an airbag system for automobiles or vehicles including the same apparatus and use of the composition as defined above in an airbag system.

In the gas generating composition for an air bag of the present invention, only advantages of the component (b), a phase stabilized ammonium nitrate can be provided by the action of the component (c), silicon compound. Consequently, a large amount of gas can be generated by combustion, and safety in handling such as production, transportation and the like can be enhanced due to low initiation sensitivity, and moreover, it can be burned successfully at lower pressure range as compared with a conventional gas generating composition containing a phase stabilized ammonium nitrate.

The gas generating composition for an air bag of the present invention can significantly downsize and reduce weight of a gas generator since generation of mist is suppressed and gas generation efficiency is enhanced on combustion by such outcome of only advantages of the component (b), a phase stabilized ammonium nitrate.

DETAILED DESCRIPTION OF THE PREFERRED EMBODIMENTS

The guanidine derivative compound, i.e. the component (a) of the present invention, acts as a fuel in the composition.

Such compound has high nitrogen content and low carbon content with chemically stable structure and can accomplish high speed burning in addition to reducing the amount of a poisonous gas (carbon monooxide) produced on combustion.

As the component (a), guanidine derivative compound, there are listed one or more compounds selected from the group consisting of nitroguanidine (NQ), guanidine nitrate (GN), guanidine carbonate, guanidine perchlorate, aminonitroguanidine, aminoguanidine nitrate, aminoguanidine carbonate, aminoguanidine perchlorate, diaminoguanidine nitrate, diaminoguanidine carbonate, diaminoguanidine perchlorate, triaminoguanidine nitrate and triaminoguanidine perchlorate. Among these compounds as the component (a), preferable are nitroguanidine, guanidine nitrate, aminonitroguanidine, aminoguanidine nitrate, diaminoguanidine nitrate and triaminoguanidine nitrate.

The content of the component (a) in the composition can be appropriately set depending on oxygen balance of a guanidine derivative compound, amount used of a binder, and the like, and is preferably from 5 to 60% by weight, particularly preferably from 5 to 50% by weight.

The phase stabilized ammonium nitrate which is the component (b) of the present invention is a component acting as an oxidant.

Examples of the phase stabilized agent include potassium salts such as potassium nitrate, potassium perchlorate, potassium chlorate, potassium chromate, potassium bichromate, potassium permanganate, potassium sulfate, potassium chloride, potassium fluoride and the like which are dissolved in hot water. The mixing ratio of ammonium nitrate to a phase stabilized agent can be appropriately set in the range wherein residues in burning are not practically problematical, and preferably, the amount of ammonium nitrate is from 98 to 70% by weight and the amount of a phase stabilized agent is from 2 to 30% by weight, and particularly preferably, the amount of ammonium nitrate is from 97 to 80% by weight and the amount of a phase stabilized agent is from 3 to 20% by weight.

Further, a solidification preventing agent can be compounded into a phase stabilized ammonium nitrate. As the solidification preventing agent, magnesium oxide, powder silica and the like can be listed. The compounding of solidification preventing agent is preferably from 0.05 to 2.0% by weight, particularly preferably from 0.1 to 1.0% by weight based on the phase stabilized ammonium nitrate.

The component (b), a phase stabilized ammonium nitrate can be obtained by a suitable physical treatment of a mixture of ammonium nitrate and a certain amount of agent and the like, for example, by evaporating and drying an aqueous solution of ammonium nitrate, phase stabilized agent or the like under heating, as well as other treatments.

The content of the component (b) in the composition is preferably from 40 to 90% by weight, particularly preferably from 50 to 85% by weight.

The component (c) used in the present invention is a silicon compound which has an activity as a pressure exponent adjuster or a detonation inhibitor.

As the component (c), silicon compound, there are listed one or more compounds selected from the group consisting of silicon nitride, silicone, silicon carbide, silicon dioxide, silicates and, clay minerals of silicates (kaoline, acid clay, bentonite and the like) and the like.

The content of the component (c) in the composition is preferably from 0.3 to 10% by weight, particularly preferably from 0.5 to 7% by weight. When the content of the component (c) is 0.3% by weight or more, initiation sensitivity can be reduced to enhance safety in handling, and further, burning can be conducted stably even under lower pressure. When the content of the component (c) is 10% by weight or less, production cost can be reduced while maintaining the above-described properties.

Into the gas generating composition for an air bag of the present invention, a combustion promoter can be further compounded in the range wherein thermal stability and mechanical properties of the composition are practically permissible. As the combustion promoter, one or more compounds are listed selected from the group consisting of metal oxides, ferrocenes, carbon black, sodium barbiturate, ammonium bichromate, potassium bichromate and the like. As the metal oxide, there are listed copper oxide, cobalt oxide, iron oxide, manganese oxide, nickel oxide, chromium oxide, vanadium oxide, molybdenum oxide or complex metal oxides thereof.

The amount compounded of the combustion promoter based on the composition is preferably from 0.05 to 5% by weight, particularly preferably 0.1 to 4% by weight.

Into the gas generating composition for an air bag of the present invention, one or more compounds selected from energetic binders and non-energetic binders can be compounded depending on increase in strength or molding ability of a gas generating agent.

Examples of the non-energetic binder include sodium carboxymethylcellulose (CMC), cellulose acetate (CA), cellulose acetate butyrate (CAB), methylcellulose (MC), hydroxyethylcellulose (HEC), polyvinylpyrrolidone (PVP) polyvinyl alcohol (PVA) or modified products thereof, polyacrylamide (PAA), polyacrylhydrazide (APAH), hydroxy terminated polybutadiene (HTPB), carboxy terminated polybutadiene (CTPB), polycarbonate, polyester, polyether, polysuccinate, polyurethane, thermoplastic rubbers, silicones and the like.

Examples of the energetic binder include azidemethylmethyloxetane, glycidyl azide polymer (GAP), polymer of 3,3-bis(azidemethyl)oxymethane, polymer of 3-nitratemethyl-3-methyloxymethane, nitrocellulose and the like.

The amount compounded of the binder component based on the composition can be appropriately set depending on molding property required for the composition, and the like, and is preferably from 2 to 25% by weight, particularly preferably from 5 to 20% by weight.

For producing the gas generating composition for an air bag of the present invention, a wet method in which mixing is conducted in the presence of water, organic solvent and the like can be used in addition to a dry method in which the components (a), (b) and (c) and the like are mixed in powder condition. Further, the composition can be compression-molded into a pellet using a tablet machine or the composition can be compression-molded into a disk using a disk molding machine. Furthermore, a pellet and disk can be ground or made into a granule using a granulator, or the composition can be extrusion-molded into an extruded agent (non-porous, single-holed, porous) using an extruder (extrusion molding machine).

In relation to the gas generating composition for an air bag of the present invention, the following formula (1) showing sensitivity of burning rate against burning pressure:

$$r=aP^n \quad (1)$$

[wherein, "r" represents a burning rate, "P" represents a burning pressure, "a" represents a constant varying depending on the kind of the gas generating composition and the initial temperature, and "n"represents a pressure exponent.]

This formula determines that "n" representing a pressure exponent at a burning pressure (P) of 50 to 70 kg/cm$^2$ is preferably of 0.95 or less, particularly preferably of 0.9 or less.

It is preferable that the gas generating composition for an air bag of the present invention is not judged as detonation by a detonator test (plastic rainpipe test) according to Japan Explosive Society standard ES-32. The detonator initiation test represents the sensitivity of explosives or explosive substances to the detonation shock caused by a detonator, therefore, due to reduction of initiation sensitivity, namely, judging of no-detonation in the above-described test, not only handling safety in production and use but also safety in all handling such as storage, transportation and the like can be improved.

EXAMPLES

The following examples and comparative examples further illustrate the present invention, but do not limit the scope thereof. Wherein, % is % by weight.

Production Example 1

Production of a Phase Stabilized Ammonium Nitrate

A mixture of 90% of ammonium nitrate (chemically pure agent manufacture by Nacalai Tesque, INC.) and 10% of potassium perchlorate ($KClO_4$) (manufactured by Japan Carlit Co., Ltd.) was dissolved in sufficient amount of distilled water (60° C.) with stirring. Subsequently, the resulted solution was charged into a thermal drier of about 90C., and water was evaporated. When most of water was evaporated, the produced solid component was spread thinly on a stainless tray, and dried well at about 90° C. The dried material was collected, and ground on a mortar so that the ground particle passes through a 300 $\mu$m sieve to obtain a phase stabilized ammonium nitrate (hereinafter, referred to as "PSA-NKP10"). Formation of the phase stabilized ammonium nitrate was confirmed by TG-DTA (thermogravimetric analysis—differential thermal analysis simultaneous measurement).

Production Example 2

PSAN-KN10, ammonium nitrate/potassium nitrate=90/10 (ratio by weight) was obtained in the same manner as in Production Example 1.

Examples 1 to 4 and Comparative Examples 1 to 3

Gas generating compositions for an air bag having compositions shown in Table 1 were obtained by dry mixing. These compositions were compression-molded into strands having a height of about 12.7 mm and a diameter of about 10 mm under a pressure of 100 kg/cm$^2$ using a hydraulic cylinder. Then, surfaces of the strands were coated with a nonflammable epoxy resin. The burning rate was measured under nitrogen atmosphere of given pressure. Each pressure exponent n was calculated based on relational formula (formula (1)) between burning rate and pressure. In the formula (1), constant represented by a is 0.104 in Example 1, 0.881 in Example 2, 0.408 in Example 3, 0.152 in Example 4, 0.018 in Comparative Example 1, 0.046 in Comparative Example 2, and 0.044 in Comparative Example 3. The results are shown in Table 1.

TABLE 1

Result of combustion behavior of gas generating compositions

| | Composition | Burning rate (mm/s, pressure kg/cm$^2$) 30 kg/cm$^2$ | 50 kg/cm$^2$ | 70 kg/cm$^2$ | Pressure exponent n (pressure range) |
|---|---|---|---|---|---|
| Comparative Example 1 | GN/PSANKP10 = 46.25/53.72 | Not ignited | 3.9 | 6.2 | 1.267 (50–70) |
| Comparative Example 2 | NQ/PSANKP10 = 41.7/58.3 | ND | 4.7 | 7.0 | 1.192 (50–70) |
| Comparative Example 3 | NQ/PSANKP10 = 42.3/57.7 | ND | 5.9 | 9.0 | 1.260 (50–70) |
| Example 1 | GN/PSANKP10/$Si_3N_4$ = 38.83/57.17/4.0 | 1.6 | 2.3 | 3.0 | 0.850 (30–70) |
| Example 2 | NQ/PSANKP10/$Si_3N_4$ = 40.1/56.1/3.8 | ND | 4.2 | 4.8 | 0.429 (50–70) |
| Example 3 | NQ/PSANKP10/$Si_3N_4$ = 35.5/60.5/4.0 | ND | 4.7 | 5.8 | 0.635 (50–70) |
| Example 4 | NQ/PSANKP10/$Si_3N_4$ = 57.4/41.6/1.0 | ND | 3.3 | 4.3 | 0.79 (50–70) |

Note:
ND means values not determined.

Examples 5 to 6 and Comparative Examples 4 to 5

Gas generating compositions for an air bag having compositions shown in Table 2 were obtained by mixing. Detonator initiation sensitivity test of a plastic rainpipe according to Japan Explosive Society standard ES-32 was conducted using these compositions. First, one end of a hard vinyl chloride rain gutter tube having an outer diameter of 30 mm, an inner diameter of 25 mm and a length of 200 mm was clogged with a rubber plug, the composition was charged through the open end of the tube, tapped slightly 3 or 4 times to be packed to upper end of the tube, and the tube opening was closed with an adhesive tape. Then, a No. 6 momentary detonator was inserted at the center of the tube opening so that the upper end of the detonator reached the same surface with the end surface of the tuber. Subsequently, a vinyl chloride rain gutter tube was buried into a depth of 200 mm from the surface of sand, and the detonator was initiated. After initiation of the detonator, detonation initiation sensitivity of the composition was judged from the size of the formed filter pore and residues. The test results are shown in Table 2.

TABLE 2

The result of detonation initiation sensitivity for gas generating compositions

| | Composition | Amount of sample (g) | Judging result |
|---|---|---|---|
| Comparative Example 4 | NQ/PSANKP10/CMC/CuO = 18.5/71.0/10.0/0.5 | 93.0 | Detonation |
| Comparative Example 5 | NQ/PSANKP10/CMC/CuO = 18.5/71.0/10.0/0.5 + additional 20% water | 99.1 | Detonation |
| Example 5 | NQ/PSANKP10/CMC/CuO/$Si_3N_4$ = 17.53/67.47/9.5/0.5/5.0 | 93.7 | Non-Detonation |
| Example 6 | NQ/PSANKP10/CMC/CuO/acid clay = 17.53/67.47/9.5/0.5/5.0 | 90.0 | Non-Detonation |

What is claimed is:

1. A gas generating composition for an air bag comprising (a) a SO guanidine derivative compound, (b) a phase stabilized ammonium nitrates and (c) a compound having an activity as a pressure exponent controller or a detonation suppressing agent, said compound (c) being at least one selected from the group consisting of silicon nitride, silicone, silicon carbide, silicon dioxide, silicates, and clay minerals of silicates.

2. The composition according to claim 1, wherein the component (a) is at least one selected from the group consisting of nitroguanidine, guanidine nitrate, guanidine carbonate, guanidine perchlorate, aminonitroguanidine, aminoguanidine nitrate, aminoguanidine carbonate, aminoguanidine perchlorate, diaminoguanidine nitrate, diaminoguanidine carbonate, diaminoguanidine perchlorate, triaminoguanidine nitrate and triaminoguanidine perchlorate.

3. The composition according to claim 1, wherein the component (b) is a mixture of 98 to 70% by weight of ammonium nitrate and 2 to 30% by weight of a phase stabilized agent.

4. The composition according to claim 3, wherein the phase stabilized agent is an inorganic or organic potassium salt compound.

5. The composition according to claim 1, further comprising at least one burning promoter selected from the group consisting of metal oxides, ferrocenes, carbon black, sodium barbiturate, ammonium bichromate and potassium bichromate.

6. The composition according to claim 5, wherein the metal oxide for the burning promoter is at least one selected from the group consisting of copper oxide, cobalt oxide, iron oxide, manganese oxide, nickel oxide, chromium oxide, vanadium oxide, molybdenum oxide and complex metal oxides.

7. The composition according to claim 1, further comprising a binder.

8. The composition according to claim 1, wherein the pressure exponent (n) at a burning pressure (P) of 50 to 70 $kg/cm^2$ is 0.95 or less, determined by the following formula (1):

$$r=aP^n \tag{1}$$

wherein "r" represents a burning rate, "P" represents a burning pressure, "a" represents a constant varying depending on the kind of the gas generating composition and the initial temperature of burning, and "n" represents a pressure exponent.

9. The composition according to claim 1, wherein the composition is not judged as detonation in detonator initiation sensitivity test of a vinyl chloride rain gutter according to Japan Explosive Society standard ES-32.

* * * * *